US008262432B2

(12) United States Patent
Sokolowski

(10) Patent No.: US 8,262,432 B2
(45) Date of Patent: Sep. 11, 2012

(54) LIGHTWEIGHT ENHANCED MODESTY SPORTS BRA CUP

(75) Inventor: Susan L. Sokolowski, Portland, OR (US)

(73) Assignee: Nike, Inc., Beaverton, OR (US)

( * ) Notice: Subject to any disclaimer, the term of this patent is extended or adjusted under 35 U.S.C. 154(b) by 340 days.

(21) Appl. No.: 12/638,438

(22) Filed: Dec. 15, 2009

(65) Prior Publication Data

US 2011/0143634 A1 Jun. 16, 2011

(51) Int. Cl.
*A41C 3/00* (2006.01)

(52) U.S. Cl. ..... 450/30; 450/92; 450/93; 450/39

(58) Field of Classification Search ..... 450/39, 450/92, 93, 30–33, 7–11; 2/115, 69, 105, 2/106, 244, 243.1
See application file for complete search history.

(56) References Cited

U.S. PATENT DOCUMENTS 4,557,267 A 12/1985 Cole
4,562,107 A * 12/1985 Daniels ..... 428/196
5,029,344 A * 7/1991 Shannon et al. ..... 2/69
5,065,458 A 11/1991 Johnson
5,518,798 A 5/1996 Riedel
6,044,492 A * 4/2000 Krogh ..... 2/115
6,175,960 B1 * 1/2001 Knittel ..... 2/115
6,421,832 B1 * 7/2002 Ondrejko et al. ..... 2/69
6,526,587 B1 * 3/2003 Jeziak et al. ..... 2/69
6,817,030 B2 11/2004 Desai
7,107,621 B2 * 9/2006 Meekins ..... 2/69
2005/0255789 A1 * 11/2005 Gaudet et al. ..... 450/41
2006/0194180 A1 * 8/2006 Bevirt et al. ..... 434/262
2007/0238392 A1 10/2007 Starbuck et al.
2008/0194180 A1 8/2008 Warren
2009/0088037 A1 4/2009 Covelli et al.

OTHER PUBLICATIONS

Notification of Transmittal of the International Search Report and the Written Opinion of the International Searchign Authority, or the Declaration, International Application No. PCT/US2010/59101, dated Feb. 3, 2011, 9 pages.

* cited by examiner

*Primary Examiner* — Gloria Hale
(74) *Attorney, Agent, or Firm* — Shook, Hardy & Bacon L.L.P.

(57) ABSTRACT

A lightweight enhanced modesty sports bra is provided. The sports bra comprises an interior liner layer having two faces and an exterior shell layer having two faces and a printed obscuration pattern in between the interior liner layer and the exterior shell layer. The interior liner layer and the exterior shell layer with the printed obscuration pattern are assembled in a way that provides modesty and the printed pattern is not visible from the outside. An optional layer called the intermediate liner layer may be placed in between the exterior shell layer and the interior liner layer.

19 Claims, 5 Drawing Sheets

LIGHTWEIGHT ENHANCED MODESTY SPORTS BRA CUP

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to bras. More particularly, the present invention relates to the enhancement of modesty for sports bra cups and improving the material stability of a sports bra.

BACKGROUND OF THE INVENTION

For professional or serious athletes lightweight athletic attire is very important for optimal performance, particularly for sports such as track and field, running intermediate and long distances, soccer and basketball. Even less serious athletes may desire lightweight attire to improve performance and/or physical comfort. However, lightweight materials might not provide an optimum level of modesty that a user desires. This may be particularly true for sports bras and similar tops worn by female athletes, which may be more revealing than desired during athletic endeavors. Further, as sports bras and similar tops have become lighter in weight, they have not necessarily provided the support desired by some female athletes.

BRIEF SUMMARY OF THE INVENTION

This summary is provided to introduce a selection of concepts in a simplified form that are further described below in the Detailed Description. This summary is not intended to identify key features or essential features of the claimed subject matter, not is it intended to be used as an aid in determining the scope of the claimed subject matter.

Embodiments of the present invention relate to the enhancement of sports bra cups with a printed obscuration pattern. In particular, the lightweight enhanced modesty sports bra cup comprises an interior liner layer of the sports bra cup having a skin face and a liner interior face and an exterior shell layer of the sports bra cup having a shell interior face and an exterior face. At least one obscuration pattern is printed between the exterior shell layer and the interior liner layer. The exterior shell layer and the interior liner layer may be connected so that the liner interior face of the interior liner layer and the shell interior face of the exterior shell layer face each other and the printed obscuration pattern is not visible from the outside. The exterior shell layer and the interior liner layer may be connected in a variety of different ways, such as by sewing a seam, using adhesive(s), using physical joiners, such as rivets, etc.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

Figure 1:
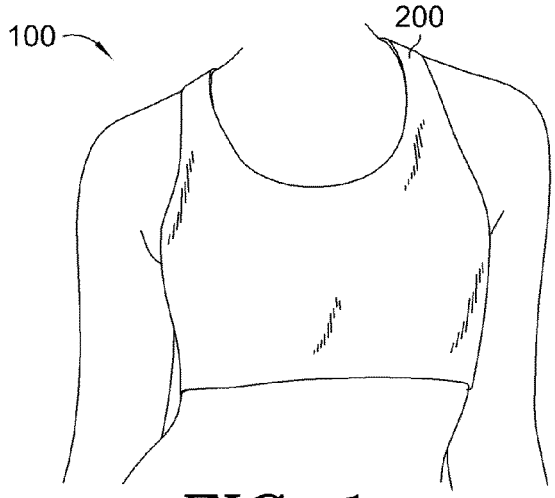
FIG. 1 illustrates a lightweight enhanced modesty sports bra being worn.

Referring now to FIG. 1, a woman 100 wearing a lightweight enhanced modesty sports bra 200 is shown. Sports bra 200 is illustrated in more detail in subsequent figures.

Figure 2:
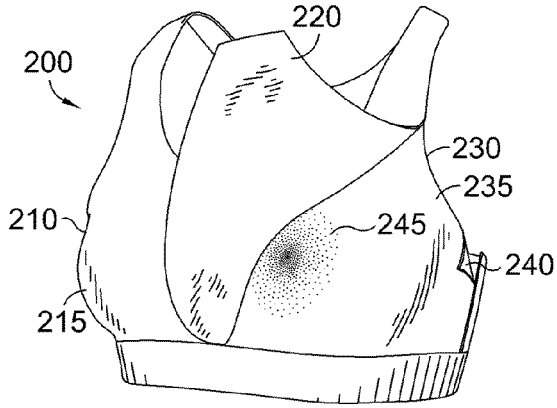
FIG. 2 illustrates a cut away view of an exemplary embodiment of a lightweight enhanced modesty sports bra with layers.

Now referring to FIG. 2, a lightweight enhanced modesty sports bra 200 is shown that includes an exterior shell layer 210 and an interior liner layer 230. The interior liner layer 230 has a liner interior face 235 and a skin face 240. The exterior shell layer 210 has an exterior face 215 and a shell interior face 220. As assembled, both liner interior face 235 and shell interior face 220 are inside sports bra 200 such that when sports bra 200 is worn neither liner interior face 235 nor shell interior face 220 contacts the skin of wearer 100 or is visible to others.

Now referring to FIG. 2, sports bra 200 includes a printed obscuration pattern 245 printed on the liner interior face 235 of the interior liner layer 230. An obscuration pattern is a pattern that provides modesty for the bra cup apex and/or provides stability in the bra cup. Printed obscuration pattern 245 may be printed on any interior face discussed or illustrated within the specification. Printed obscuration pattern 245 is illustrated in more detail in FIG. 9. For brevity only a few examples are discussed, but the claimed invention is not limited to only these examples.

The obscuration pattern may provide modesty for the bra cup apex by obscuring the view of a woman's nipple. For providing modesty for the bra cup apex, only the area of the bra cup apex needs to have a printed obscuration pattern. Once the sports bra 200 is worn by a user, the printed obscuration pattern is not seen through the outside of the sports bra 200. For providing material stability in the bra cup, the printed obscuration pattern 245 may extend beyond the apex of the bra cup, potentially over the entirety of the bra cup area. The printed obscuration pattern 245 printed one of the interior face has less elasticity than the exterior shell layer and the interior liner layer without the printed obscuration pattern and therefore, provides material stability to the bra cup. The configuration of the printed obscuration pattern and/or the type of material printed may be varied to provide varying amounts of support.

Figure 3:
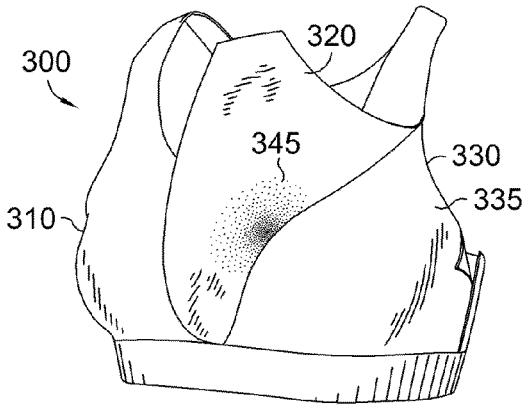
FIG. 3 illustrates a cut away view of another exemplary embodiment of a lightweight enhanced modesty sports bra.

Referring to FIG. 3, a lightweight enhanced modesty sports bra 300 is illustrated having a printed obscuration pattern 345 on the shell interior face 320 of the exterior shell layer 310. Similar to the lightweight enhanced modesty sports bra 200 illustrated in FIG. 2, obscuration pattern 345 now printed on shell interior face 320 of the exterior shell layer 310 provides enhanced modesty at the bra cup apex.

Figure 4:
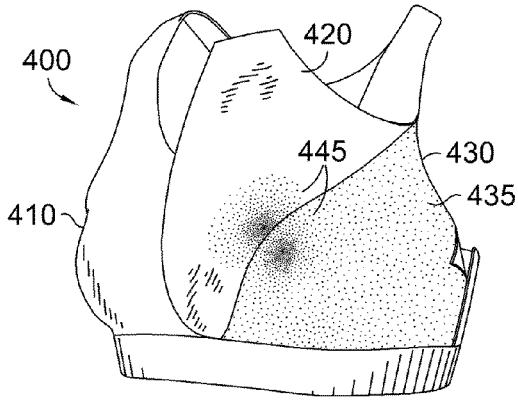
FIG. 4 illustrates a cut away view of an exemplary embodiment of a lightweight enhanced modesty sports bra with an intermediate liner layer.

FIG. 4 illustrates an example of a lightweight enhanced modesty sports bra 400 with two printed obscuration patterns 445, a first obscuration pattern printed on the liner interior face 435 of the interior liner layer 430 and a second obscuration pattern printed on the shell interior face 420 of the exterior shell layer 410. The use of both a first obscuration pattern and a second obscuration pattern may provide a yet further enhancement of the modesty of the sports bra 400 without needlessly increasing the weight of the bra 400. The printed obscuration pattern 445 printed it on the liner interior face 435 extends over the entirety of the interior liner face 435. The use of two printed obscuration patterns may also be utilized to provide an extra stability for the bra cup. Extending the printed obscuration pattern 445 over a substantial portion of the bra cup may also provide additional material stability for the sports bra 400 over the bra cup.

Any of a variety of techniques may be used to print an obscuration pattern onto one of the interior faces, maybe including but not limited to screen printing techniques or silicone printing techniques or a combination of the two. An obscuration pattern may also be printed in layers on the same interior face or on different interior faces. Two different patterns may function in conjunction with each other to further provide modesty and stability. The type of printer that may be used to print the obscuration pattern onto one of the interior faces are enabled to print onto various types of fabric and material, such as the materials described herein.

Figure 5:
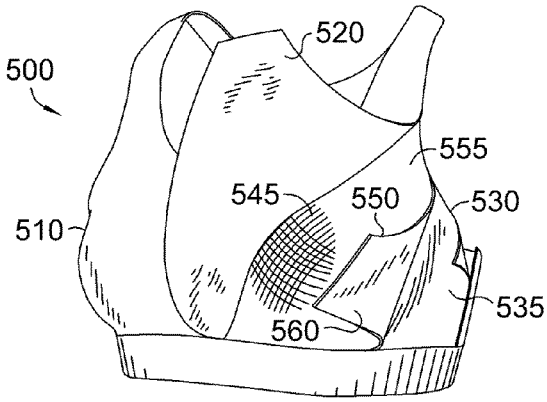
FIG. 5 illustrates a cut away view of another exemplary embodiment of a lightweight enhanced modesty sports bra with an intermediate liner layer.

Now referring to FIG. 5, the lightweight enhanced modesty sports bra 500 further including an optional intermediate liner layer 550 is shown. Intermediate liner layer 550 has a first interior face 555 and a second interior face 560. The first interior face 555 faces the shell interior face 520 of the exterior shell layer 510 and the second interior face 560 faces the liner interior face 535 of the interior liner layer 530. The intermediate liner layer 550 is an optional piece of material that may provide extra material stability and extra modesty coverage.

Sports bra 500 includes a printed obscuration pattern 545 on the first interior face 555 of the intermediate liner layer 550. Printed obscuration pattern 545 is illustrated in more detail in FIG. 10. The printed obscuration pattern 545 may only cover the bra apex area as shown to provide modesty. The printed obscuration pattern 545 may also be extended over the entirety of the first interior face 555 of the intermediate liner layer 550 to provide additional material stability of the bra cup.

Figure 6:
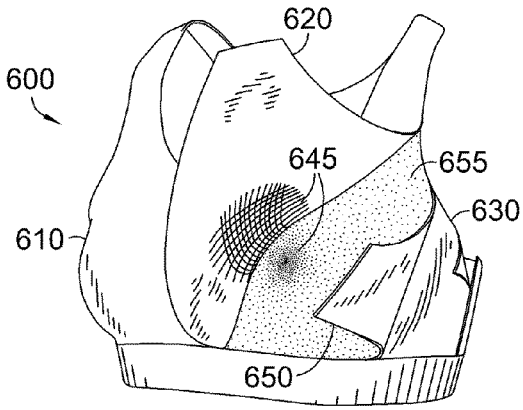
FIG. 6 illustrates a cut away view of another exemplary embodiment of a lightweight enhanced modesty sports bra with an intermediate liner layer.

Now referring to FIG. 6, the lightweight enhanced modesty sports bra 600 including a printed obscuration pattern 645 on the shell interior face 620 of the exterior shell layer 610 and a printed obscuration pattern 645 on the first interior face 655 of the intermediate liner layer 650 is shown. The printed obscuration patterns shown in FIG. 6 illustrate examples of different obscuration patterns that may be used to provide additional modesty coverage and additional material stability. Any combination of obscuration patterns may be used, and the claimed invention is not limited to only these examples. An obscuration pattern may be printed on any combination of the interior faces within the sports bra.

Figure 8:
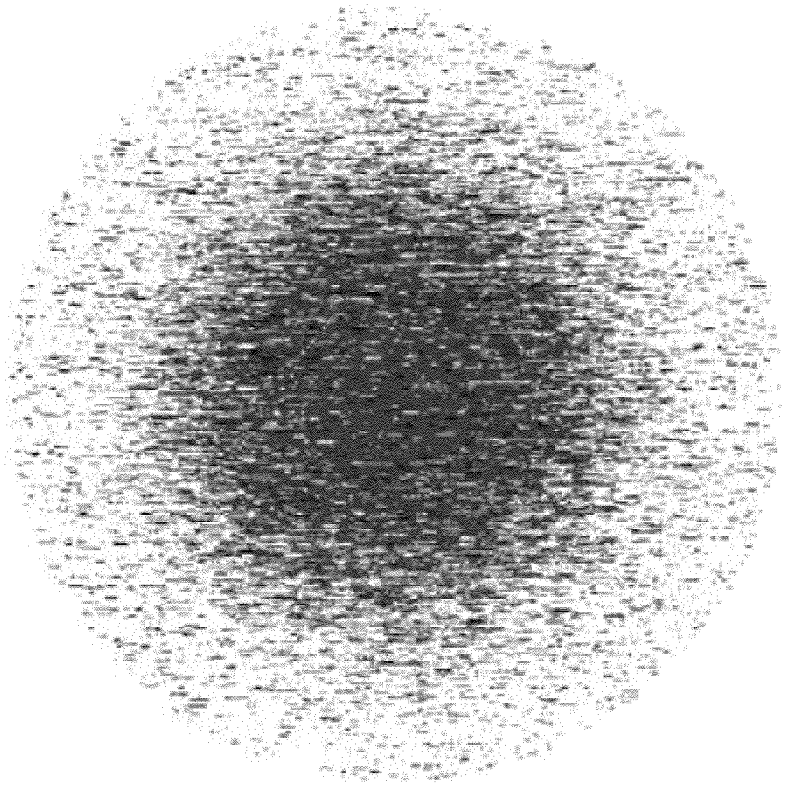
FIG. 8 illustrates another exemplary printed obscuration pattern for use with a lightweight enhanced modesty sports bra.
Figure 7:
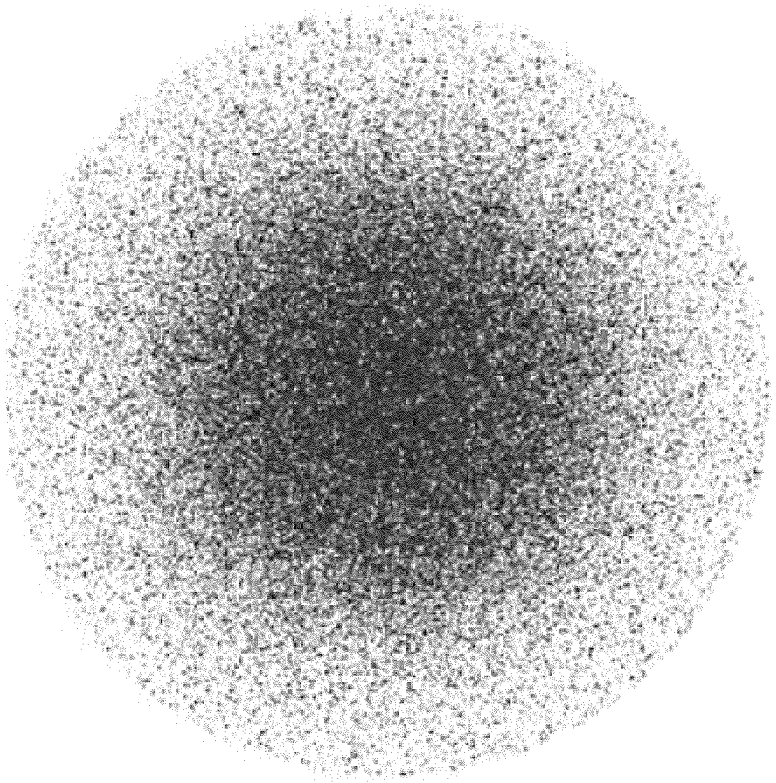
FIG. 7 illustrates an exemplary printed obscuration pattern for use with a lightweight enhanced modesty sports bra.

FIG. 7 and FIG. 8 illustrate two examples of types of obscuration patterns that may be used to provide modesty to the bra cup apex area. FIG. 7 shows a configuration of differently spaced dots to provide an overall obscuration pattern. FIG. 8 shows a configuration of irregularly shaped lines and dots differently spaced to create an overall obscuration pattern. Other types of patterns, such as those discussed herein, may also be used to provide material stability as well.

Figure 9:
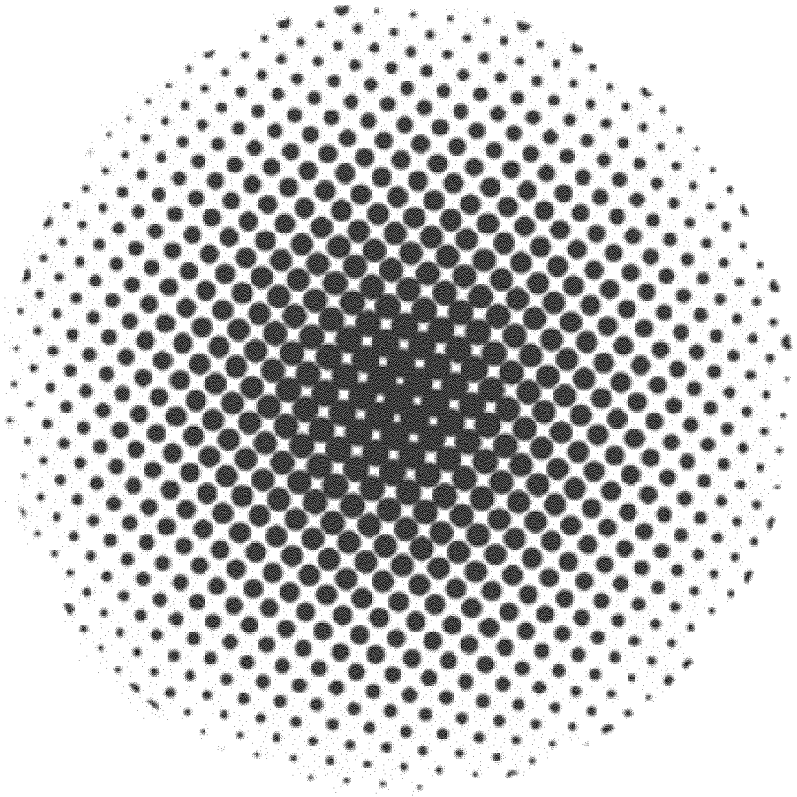
FIG. 9 illustrates another exemplary printed obscuration pattern for use with a lightweight enhanced modesty sports bra.

Now referring to FIG. 9, another example of a type of obscuration pattern that may be used to provide modesty to the bra cup apex area is illustrated. FIG. 9 shows a configuration of differently sized dots and different amounts of spacing between the dots to create another type of obscuration pattern.

Figure 10:
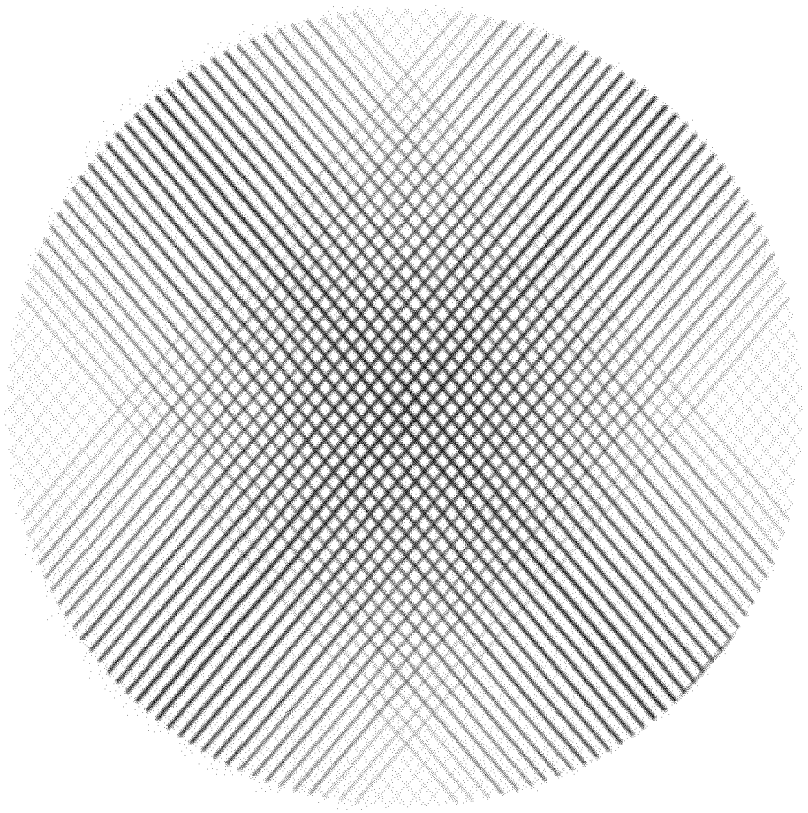
FIG. 10 illustrates another exemplary printed obscuration pattern for use with a lightweight enhanced modesty sports bra.

FIG. 10 illustrates another example of a type of obscuration pattern that may be used to provide modesty to the bra cup apex area. FIG. 10 shows a configuration of a grid or matrix pattern of lines with each line possibly having different gradients of color to create an overall obscuration pattern. An obscuration pattern such as illustrated in FIG. 10 may be particularly useful for providing enhanced support as well as enhanced modesty.

Figure 11:
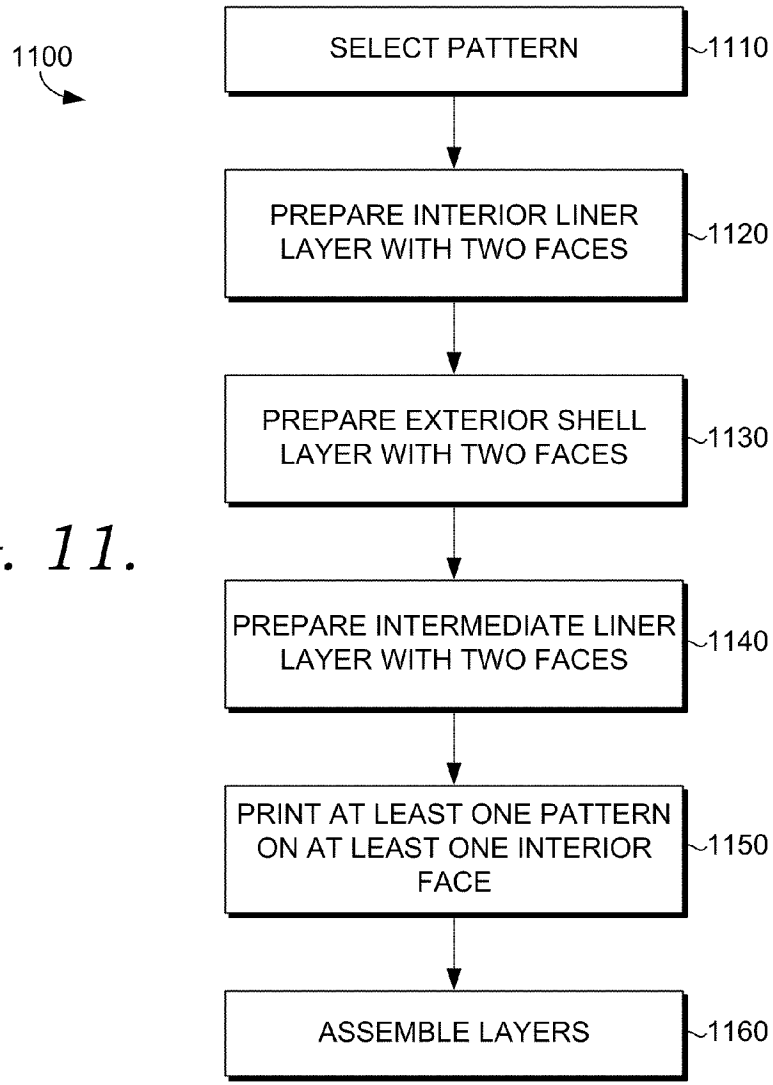
FIG. 11 is a flow diagram that illustrates an overall process for creating a lightweight enhanced modesty sports bra.

Now referring to FIG. 11, a flow diagram illustrates an overall process 1100 for creating a lightweight enhanced modesty sports bra. First, an obscuration pattern is selected in step 1110. Any obscuration pattern, such as the example obscuration patterns discussed, above may be used. An interior liner layer with two faces, a skin face and a liner interior face, is prepared in step 1120. The interior liner layer may be made of a moisture management material. An exterior shell layer with two faces, an exterior face and a shell interior face, is prepared in step 1130. The exterior shell layer may be made of a variety of materials, such as polyester, nylon, spandex, cotton or any combination of these.

Optionally, an intermediate liner layer with two faces, a first interior face and a second interior face may be prepared in step 1140. The intermediate liner layer may be made of moisture management material. The optional intermediate liner layer may provide extra modesty to the bra cup apex area and further material stability. At least one obscuration pattern is printed on at least one interior face in step 1150. The at least one interior face on which the obscuration pattern is printed on in step 1150 may be the liner interior face of the interior liner layer, the shell interior face of the exterior shell layer, and/or one or both of the interior faces of the optional intermediate liner layer. The printed obscuration pattern printed on one of the interior faces has less elasticity than the material of the exterior shell layer, intermediate liner layer and/or interior liner layer without the printed obscuration pattern and therefore, provides more material stability to the overall assembly.

Next, each layer is assembled in step 1160 so that the liner interior face of the interior liner layer faces the shell interior face of the exterior shell layer and the printed obscuration pattern is not visible from the outside. If the optional intermediate liner layer is included, then it is placed in between the exterior shell layer and the interior liner layer so that the first interior face is facing the shell interior face of the exterior shell layer and the second interior face of the intermediate liner layer is facing the liner interior face of the interior liner layer. The different layers may be connected in a variety of different methods including but not limited being to sewn together, using ultrasonic welding, using adhesive(s), or using physical joiners such as rivets, etc.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

The invention claimed is:

1. A lightweight enhanced modesty sports bra cup made by a process comprising the steps of:

preparing an interior liner layer of the sports bra cup having a skin face and liner interior face, the interior liner layer having a first elasticity;

preparing an exterior shell layer of the sports bra cup having a shell interior face and an exterior face, the exterior shell layer having a second elasticity;

printing, using printable materials, at least one obscuration pattern onto at least a portion of at least one of the liner interior face or the shell interior face of the sports bra cup, the at least one obscuration pattern:

(1) imparting a third elasticity to the at least a portion of the at least one of the liner interior face or the shell interior face, the third elasticity being less than the first and second elasticity, (2) having areas of opacity and areas of non-opacity, and (3) configured to obscure visual viewing through the at least a portion of the at least one of the liner interior face or the shell interior face; and permanently attaching the exterior shell layer and the interior liner layer together such that the liner interior face of the interior liner layer faces the shell interior face of the exterior shell layer.

2. The lightweight enhanced modesty sports bra cup of claim 1, wherein the at least a portion of the at least one of the liner interior face or the shell interior face of the sports bra cup to which the at least one obscuration pattern is printed comprises an apex portion of the bra cup.

3. The lightweight enhanced modesty sports bra cup of claim 1, wherein the at least a portion of the at least one of the liner interior face or the shell interior face of the sports bra cup to which the at least one obscuration pattern is printed comprises an entirety of an interior face of the sports bra.

4. The lightweight enhanced modesty sports bra cup of claim 1, wherein the interior liner layer of the sports bra cup is made of a moisture management material.

5. The lightweight enhanced modesty sports bra cup of claim 1, the process of making the sports bra cup further comprising printing the at least one obscuration pattern onto at least a portion of both the liner interior face of the interior liner layer and the shell interior face of the exterior shell layer.

6. The lightweight enhanced modesty sports bra cup of claim 1, wherein printing the at least one obscuration pattern comprises screen printing the at least one obscuration pattern.

7. The lightweight enhanced modesty sports bra cup of claim 1, wherein the printable materials comprise silicone ink.

8. A lightweight enhanced modesty sports bra cup comprising:

an interior liner layer having a skin face and a liner interior face, the interior liner layer having a first elasticity;

an exterior shell layer having a shell interior face and an exterior face, the exterior shell layer having a second elasticity;

an obscuration pattern printed, using printable materials, on at least a portion of at least one of the liner interior face or the shell interior face, the obscuration pattern:

(1) having a third elasticity, the third elasticity being less than the first elasticity and the second elasticity, (2) having areas of opacity and areas of non-opacity, and (3) configured to obscure visual viewing through the at least a portion of the at least one of the liner interior face or the shell interior face; and a permanent connection between the exterior shell layer and the interior liner layer so that the liner interior face of the interior liner layer and the shell interior face of the exterior shell layer face each other.

9. The lightweight enhanced modesty sports bra cup of claim 8, further comprising an intermediate liner layer in between the interior liner layer and the exterior shell layer, the intermediate liner layer having a first interior face and a second interior face.

10. The lightweight enhanced modesty sports bra cup of claim 9, wherein the obscuration pattern further comprises at least two obscuration patterns printed on the at least a portion of the at least one of the liner interior face or the shell interior face of the sports bra cup.

11. The lightweight enhanced modesty sports bra cup of claim 8, wherein the connection further comprises stitching that sews the interior liner layer and exterior shell layer together.

12. The lightweight enhanced modesty sports bra cup of claim 8, wherein the obscuration pattern comprises a first obscuration pattern and a second obscuration pattern, wherein:

(1) the first obscuration pattern is different from the second obscuration pattern, (2) the first obscuration pattern substantially overlays the second obscuration pattern, and (3) the obscuration pattern is printed on the at least a portion of only one of the liner interior face or the shell interior face.

13. The lightweight enhanced modesty sports bra cup of claim 8, wherein the obscuration pattern comprises a matrix of dots.

14. The lightweight enhanced modesty sports bra cup of claim 8, wherein the obscuration pattern comprises a series of lines.

15. A method for manufacturing a lightweight enhanced modesty sports bra cup, comprising the steps of:

preparing an interior liner layer having a skin face and a liner interior face, the interior liner layer having a first elasticity;

preparing an exterior shell layer having a shell interior face and a exterior face, the exterior shell layer having a second elasticity;

printing, using printable materials, at least one obscuration pattern on at least a portion of at least one of the liner interior face or the shell interior face of the sports bra cup, the at least one obscuration pattern:

(1) imparting a third elasticity to the at least a portion of the at least one of the liner interior face or the shell interior face, the third elasticity being less than the first elasticity and the second elasticity, (2) having areas of opacity and areas of non-opacity, and (3) configured to obscure visual viewing through the at least a portion of the at least one of the liner interior face or the shell interior face; and permanently attaching the exterior shell layer and the interior liner layer together such that the liner interior face of the interior liner layer faces the shell interior face of the exterior shell layer.

16. The method of claim 15, wherein the at least one obscuration pattern comprises a first obscuration pattern and a second obscuration pattern, wherein:

(1) the first obscuration pattern is different from the second obscuration pattern, (2) the first obscuration pattern substantially overlays the second obscuration pattern when the lightweight enhanced modesty sports bra cup is in an as-worn position, and (3) the first obscuration pattern is printed on at least a portion of the liner interior face, and the second obscuration pattern is printed on at least a portion of the shell interior face.

17. The method of claim 15, wherein printing the at least one obscuration pattern further comprises screen printing the at least one obscuration pattern.

18. The method of claim 15, wherein the printable materials comprise silicone ink.

19. The lightweight enhanced modesty sports bra cup of claim 1, wherein the first elasticity is different from the second elasticity.

* * * * *